US007021911B2

(12) United States Patent
Moradmand et al.

(10) Patent No.: US 7,021,911 B2
(45) Date of Patent: Apr. 4, 2006

(54) REVERSE-PORTED PUMP

(75) Inventors: Jamshid Moradmand, Dayton, OH (US); David F. Reuter, Beavercreek, OH (US); E. Wayne Lloyd, Lebanon, OH (US); Darrell M. Bybee, Dayton, OH (US)

(73) Assignee: Delphi Technologies, Inc., Troy, MI (US)

( * ) Notice: Subject to any disclaimer, the term of this patent is extended or adjusted under 35 U.S.C. 154(b) by 302 days.

(21) Appl. No.: 10/397,728

(22) Filed: Mar. 26, 2003

(65) Prior Publication Data

US 2004/0191099 A1 Sep. 30, 2004

(51) Int. Cl.
*F04B 19/00* (2006.01)

(52) U.S. Cl. ..... 417/470; 417/471; 417/273; 417/540; 417/570

(58) Field of Classification Search ..... 417/470, 417/570, 540, 273, 471
See application file for complete search history.

(56) References Cited

U.S. PATENT DOCUMENTS 5,199,860 A 4/1993 Stegmaier
5,823,639 A 10/1998 Zinnkann et al.
6,199,962 B1 * 3/2001 Dokas et al. ..... 303/116.4
6,220,833 B1 4/2001 Lewis
6,238,189 B1 * 5/2001 Guentert ..... 417/273
6,450,787 B1 * 9/2002 Risch et al. ..... 417/569
6,481,452 B1 11/2002 Reuter et al.
6,764,286 B1 * 7/2004 Hunnicutt et al. ..... 417/470
2003/0101970 A1 * 6/2003 Utsumi ..... 123/495
2004/0166004 A1 * 8/2004 Schmitt et al. ..... 417/470

* cited by examiner

*Primary Examiner*—Charles G. Freay
*Assistant Examiner*—Ryan P. Gillan
(74) *Attorney, Agent, or Firm*—Michael D. Smith

(57) ABSTRACT

A pump used in vehicle controlled braking systems provides a reverse direction of flow through a cylinder bore of the pump and utilizes an inlet check valve located outside of the piston at the end of the cylinder bore opposite the piston, in conjunction with an outlet check valve located in an outlet extending through a sidewall of the cylinder bore of the pump. The inlet check valve is assembled and tested as a module prior to being installed in the pump. A fluid reservoir, having a movable wall, is connected to the inlet to facilitate priming the pump module. The piston is driven by a self-supporting drive apparatus with an eccentric element affixed to a stub shaft, or by other forms of a drive apparatus having an eccentric element fixed to a motor drive shaft.

6 Claims, 8 Drawing Sheets

REVERSE-PORTED PUMP

TECHNICAL FIELD OF THE INVENTION

This invention relates piston pumps, and more particularly to hydraulic piston pumps of the type used in controlled braking systems for vehicles.

BACKGROUND OF THE INVENTION

Modern vehicles, such as automobiles, trucks, buses, motorcycles, and motor homes are often equipped with sophisticated controlled braking systems that provide anti-lock braking (ABS), traction control (TCS), or stability control (SCS). During controlled braking events, an automated control unit takes control of the brake system and regulates the flow and pressure of hydraulic brake fluid to the brakes in a manner that would not be achievable through manual control by the driver.

Such controlled braking systems typically include a hydraulic pump driven by an electric motor that is activated during controlled braking events, to provide a continuous flow of pressurized brake fluid for use by control valves connected to the brakes, in accordance with control signals received from the automated control unit. A typical controlled braking pump includes a pump housing, a pair of piston pump cartridges or modules mounted in the pump housing in an opposed fashion along a reciprocating axis, and an electric motor attached to the block pump housing and having a drive shaft with an eccentric connected to pistons in the pump cartridges for driving the pistons in a reciprocating motion along the axis. The pump cartridges also typically each include inlet and outlet check valves for regulating the flow of hydraulic brake fluid in and out of the cartridges.

In prior controlled braking pumps, the inlet check valve was typically a part of and moved with the piston. U.S. Pat. No. 5,823,639, to Zinnkann et al., and U.S. Pat. No. 5,199,860 to Stegmaier, disclose piston pumps for vehicle braking systems in which the inlet check valve is located inside of the piston. The inlet valves disclosed in these patents receive fluid from passages in the sidewall of a cylinder bore housing the piston. An outlet valve is located along a reciprocating axis of the piston at the end of the cylinder bore opposite the piston.

Locating the inlet valve inside of the piston, and locating the outlet valve at the end of the cylinder bore, in the manner exemplified by Zinnkmann and Stegmaier, causes the piston to be complex, having parts that are difficult and costly to manufacture and assemble. The piston must also be made long enough to accommodate the inlet valve and provide room for movement of any moving parts of the inlet valve, thereby resulting in a piston and pump that are undesirably long. This extra length also sometimes limits the stroke of the piston that can be utilized in the space allowable for the pump under the hood of a vehicle. Having the inlet valve inside of the piston can also generate undesirable noise when the pump is operating.

In another prior approach disclosed in U.S. Pat. No. 6,220,833 B1, to Lewis, an ABS pump uses a specially shaped lip seal mounted on the outside of the piston instead of an inlet valve located inside of the piston. The piston and pump of Lewis are still undesirably complex, costly, and difficult to fabricate and assemble.

What is needed, therefore, is an improved controlled braking pump that provides a solution to one or more of the problems described above.

SUMMARY OF THE INVENTION

The present invention provides an improved pump, suitable for use in vehicle controlled braking systems, by reversing the direction of flow through the cylinder bore of the pump, and utilizing an inlet check valve located outside of the piston at the end of the cylinder bore opposite the piston in conjunction with an outlet check valve located in an outlet extending through a sidewall of the cylinder bore of the pump.

In one form of the invention, a pump module includes a sleeve having a wall defining, a first and a second axial end of the sleeve, a cylinder bore including a sidewall, a reciprocating axis extending through the cylinder bore from the first to the second axial ends of the sleeve, an inlet extending along the reciprocating axis from the first axial end of the sleeve in fluid communication with the cylinder bore, and an outlet passing through the wall of the sleeve and in fluid communication with the cylinder bore between the first and second axial ends of the sleeve. The pump module further includes a piston, an inlet check valve and an outlet check valve. The piston is mounted in the cylinder bore for sliding motion along the reciprocating axis, and has an exposed end thereof extending from the second end of the sleeve adapted for connection to a drive mechanism. The inlet check valve assembly is disposed in the inlet, and the outlet check valve assembly is disposed in the outlet.

The pump module may further include a return spring operatively connected between the second end of the sleeve and the exposed end of the piston for urging the exposed end of the piston to move outward from the sleeve along the reciprocating axis.

The inlet check valve assembly may include a seat, a ball, a cage, and a compression spring, with the seat defining an inlet orifice extending through the seat. The ball blocks the inlet orifice when the ball is in a seated position resting against the seat. The cage is attached to the seat for retaining and guiding the ball from the seated position, where the ball is resting against the seat and blocking the inlet orifice, to an open position, where the ball is not resting against the seat and the inlet orifice is unblocked. The compression spring is disposed between the cage and the ball for urging the ball toward the seat.

The inlet check valve may be provided as an assembly that can be assembled and tested independently from the remainder of the pump. The inlet of the pump defines an inlet check valve bore for receiving the inlet check assembly, and the inlet check valve assembly comprises an inlet check valve housing defining the seat, and further defining an outer surface thereof adapted for a press fit into the bore for receiving an inlet check valve assembly.

A pump module according to the invention may also include a cap at the first end of the sleeve for closing the inlet. The cap may include a fluid reservoir in fluid communication with the inlet, for providing a small volume of fluid to the inlet of the pump for priming the pump during start-up of the pump at cold temperatures. The fluid reservoir may include a movable wall for varying the fluid holding capacity of the fluid reservoir, and a spring element disposed between the cap and the movable wall for urging the movable wall to move toward a maximum capacity condition of the fluid reservoir. The movable wall may include a flexible diaphragm partially bounding the fluid reservoir.

The invention may also take the form of a pump, including a pump housing having a cavity for receiving the sleeve, and a pump drive apparatus attached to the pump housing and including a rotating eccentric operatively connected to the exposed end of the piston for imparting reciprocating motion to the piston within the cylinder bore. The drive apparatus may alternatively include a rotating drive shaft of a motor having the eccentric attached to the drive shaft, or a stub shaft having the eccentric attached thereto and journalled in the pump housing.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

DETAILED DESCRIPTION

Figure 1:
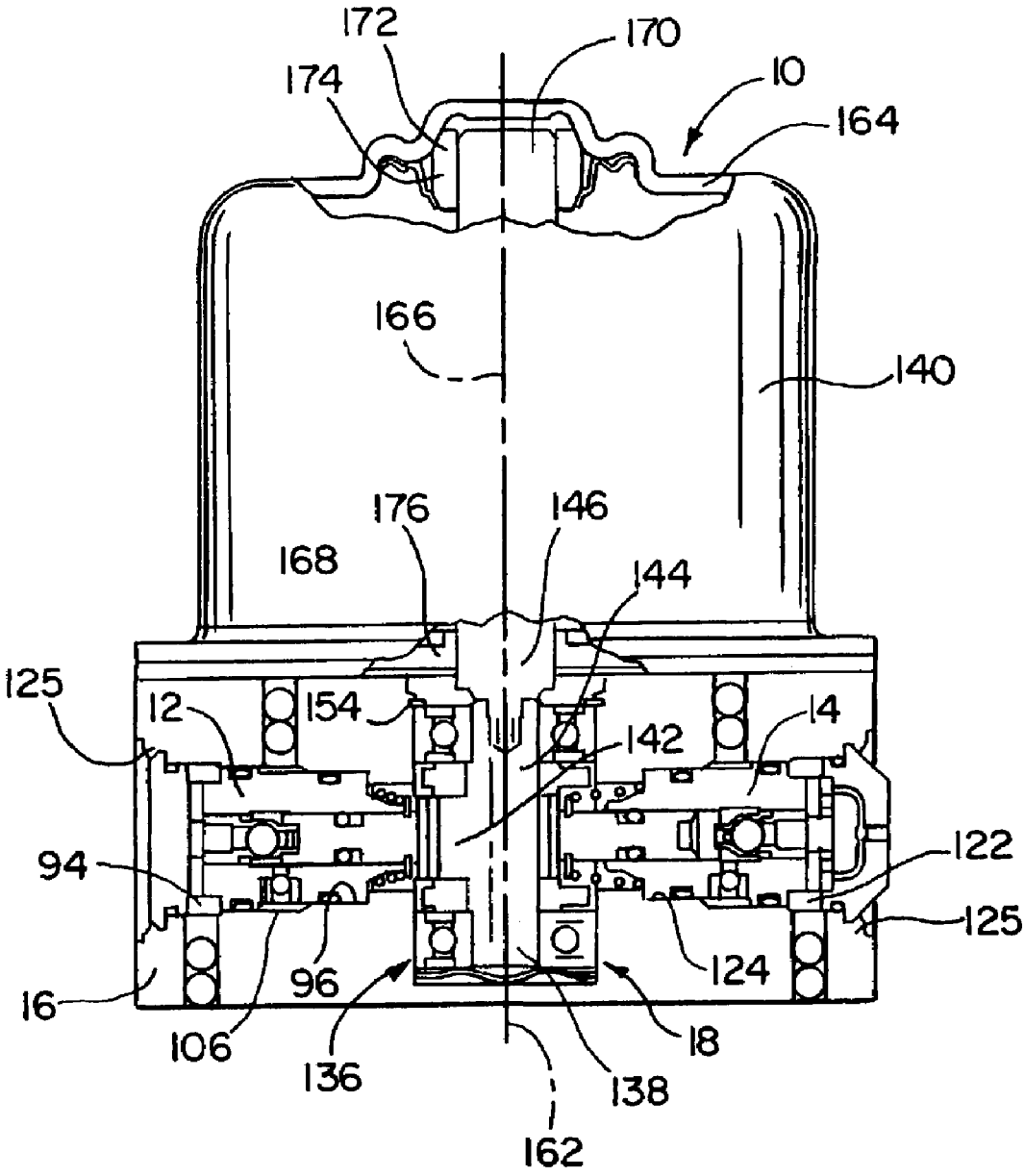
FIG. 1 is partial cross-section of an exemplary embodiment of a pump, according to the invention.

FIG. 1 shows a first exemplary embodiment of a pump 10, according to the invention. The pump 10 includes a first and a second pump module 12, 14, a pump housing 16, and a pump drive apparatus 18.

Figure 2:
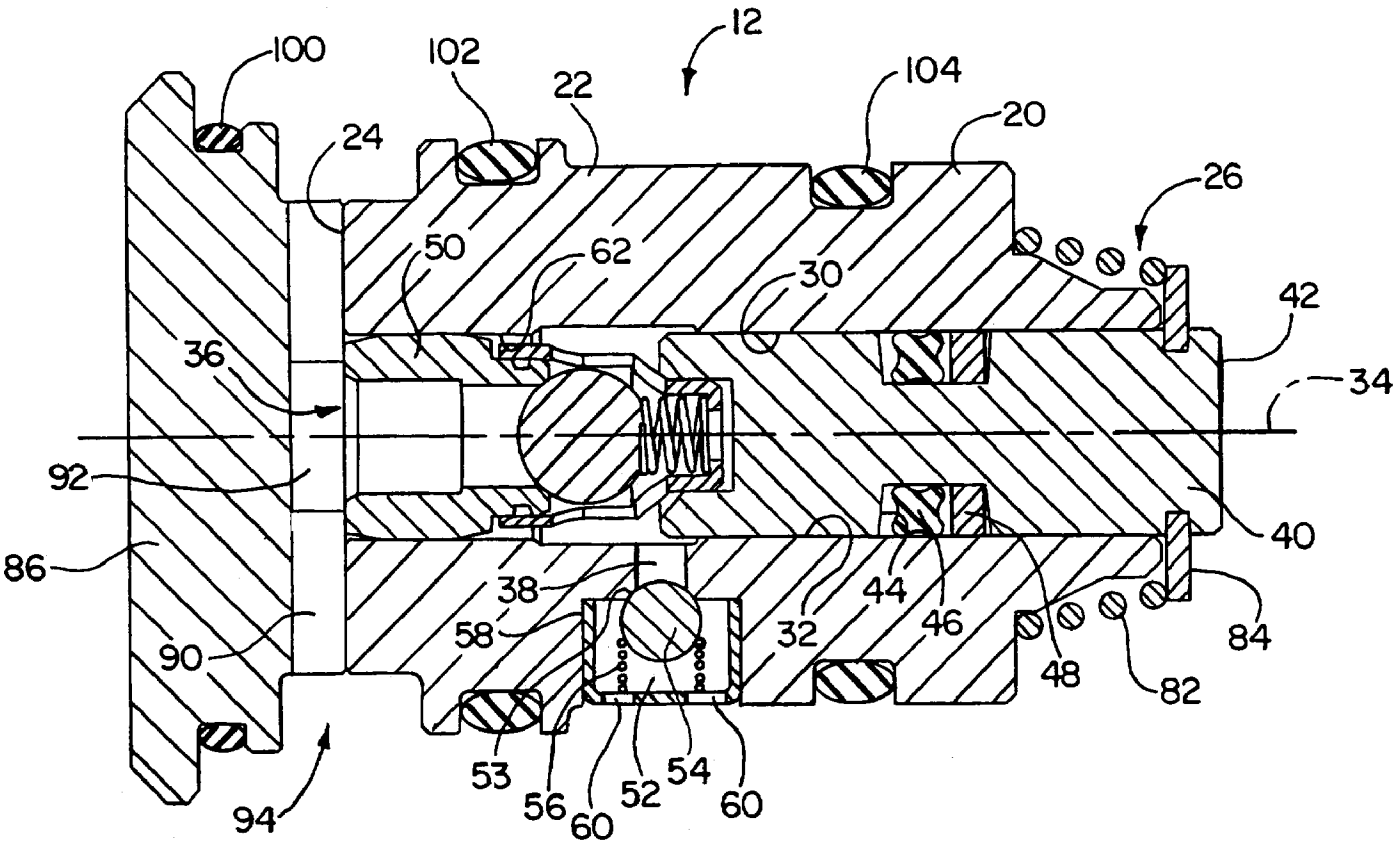
FIG. 2 is a cross section of a first pump module, according to the invention, of the pump of FIG. 1.
Figure 3:
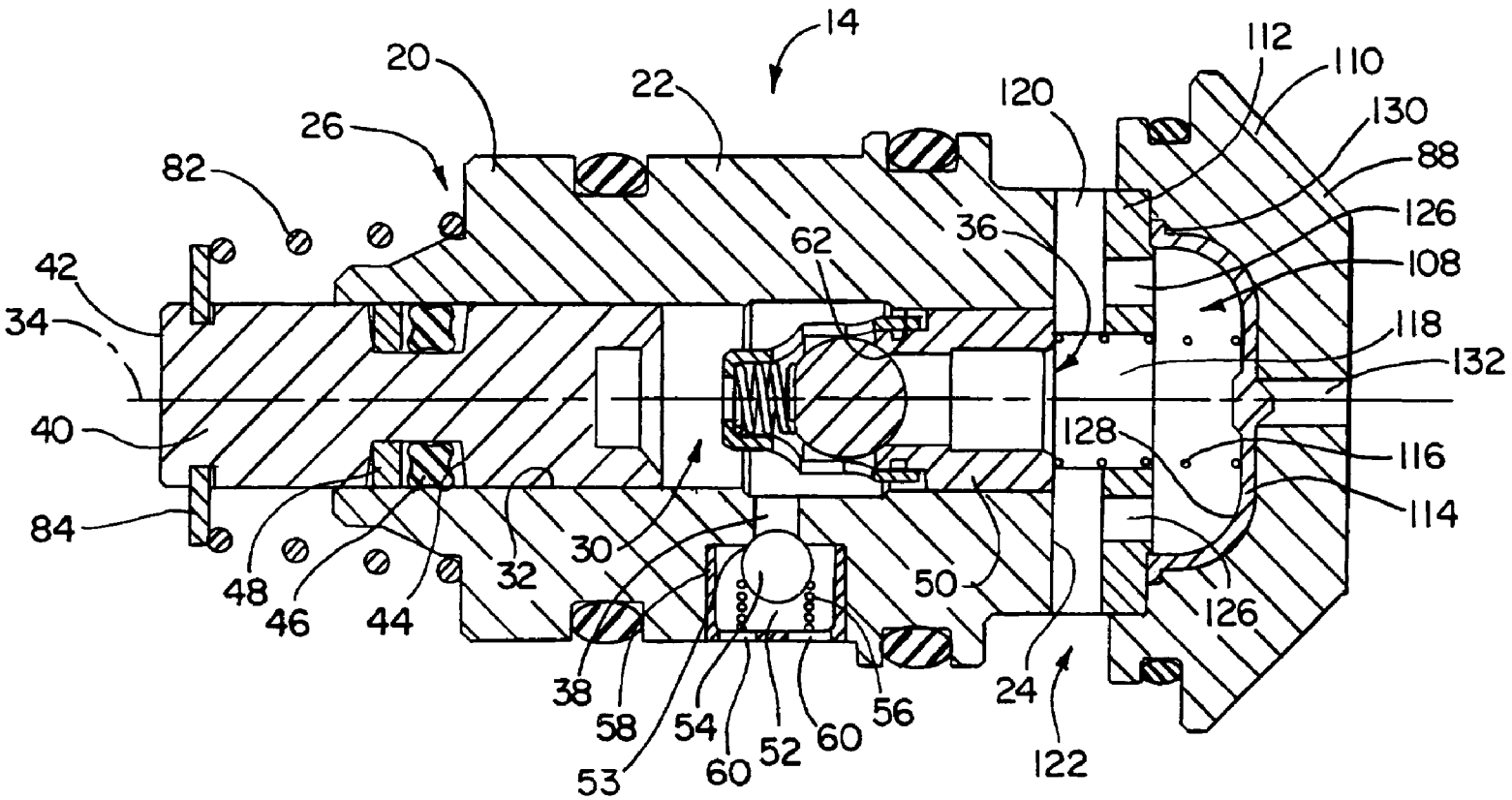
FIG. 3 is a cross section of a second pump module, according to the invention, of the pump of FIG. 1, having a fluid reservoir, according to the invention, at the inlet of the pump module.
Figure 4:
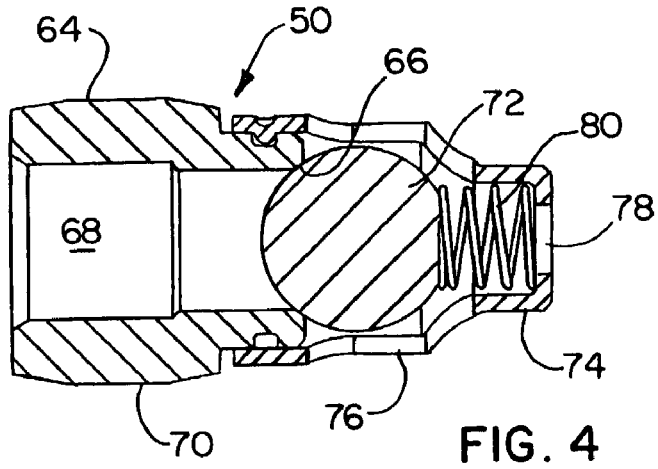
FIG. 4 is an enlarged cross section of an inlet check valve assembly, according to the invention, of the first and second pump modules shown in FIGS. 1–3.

As shown, in FIGS. 1–3, the first and second pump modules 12, 14, each include a sleeve 20 having a wall 22 defining, a first and a second axial end 24, 26 of the sleeve 20. The wall 22 of each of the sleeves 20 also defines, a cylinder bore 30 including a sidewall 32, and a reciprocating axis 34 extending through the cylinder bore 30 from the first to the second axial ends 24, 26 of the sleeve 20. The wall 22 of each of the sleeves 20 further defines an inlet 36 extending along the reciprocating axis 34 from the first axial end 24 of the sleeve 20 in fluid communication with the cylinder bore 30, and an outlet 38 passing through the wall 22 of the sleeve 20 and in fluid communication with the cylinder bore 30 between the first and second axial ends 24, 26 of the sleeve 20.

The first and second pump modules 12, 14 each also include a piston 40 in the cylinder bore 30 for sliding motion along the reciprocating axis 34, and having an exposed end 42 thereof extending from the second end 26 of the sleeve 20 adapted for connection to the pump drive mechanism 18. The piston 40 is generally a simple cylindrical shape, with an annular groove 44 in the outer surface thereof for receipt of a sliding seal ring 46 and a back-up ring 48 for providing a sliding seal between the piston 40 and the sidewall 32 of the cylinder bore 30.

Each of the first and second pump modules 12, 14 include an inlet check valve assembly 50 disposed in the inlet 36, and an outlet check valve assembly 52 disposed in the outlet 38. The outlet 38 is stepped, with the outer edge of an inner smaller diameter segment of the outlet 38 forming a seat 53 of the outlet check valve 52. The outlet check valve assembly 52 also includes a ball 54 and a compression spring 56 for biasing the ball 54 to remain in a seated position against the seat 53. The ball 54 and spring 56 are held in place by a cup-shaped retainer 58, inserted into an outer larger diameter segment of the outlet 38, and having openings 60 for passage of fluid out of the outlet 58. The spring 56 in the outlet check valve 52 holds the ball 54 against the seat 53 until sufficient pressure has been generated in the cylinder bore 30 to overcome the preload of the spring 56. The construction of our modules 12, 14 allows the outlet check valve 52 to be fabricated and installed at a lower cost and with less difficulty that was the case in prior controlled braking pumps.

As shown in FIGS. 1–3, the inlets 36 of the pump modules 12, 14 define an inlet check valve bore 62 for receiving the inlet check assembly 50. As shown, in FIGS. 1–4, the inlet check valve assemblies 50 include an inlet check valve housing 64, having a seat 66 which in turn defines an inlet orifice 68 extending through the seat 66 and the inlet check valve housing 64. The outer surface 70 of the inlet check valve housing 64 is adapted for a press fit into the inlet check valve bores 62 in the pump modules 12, 14. The outer surface 70 of the inlet check valve housings 64 in the exemplary embodiment are preferably curved in a slightly convex barrel shape to facilitated press fitting the inlet check valve assemblies 50 into the inlet check valve bores 62 of the pump modules 12, 14. In addition, the press fit surface 70 of the check valve housing 64 is located sufficiently far from seat 66 such that any distortion caused by the press fit will not effect the geometry of seat 66. This assures a high quality, leak-free seat can be more easily obtained during the final assembly process.

Each of the inlet check valve assemblies 50 further includes a ball 72, blocking the inlet orifice 68 when the ball 72 is in a seated position resting against the seat 66, and a cage 74 attached to the seat 66 for retaining and guiding the ball 72 from the seated position resting against the seat 66 and blocking the inlet orifice 68, to an open position where the ball 72 is not resting against the seat 66 and the inlet orifice 68 is unblocked. The cage 74 includes openings 76 in the sides and end 78 thereof for fluid to pass through the cage 74 from the inlet 36 into the cylinder bore 30. A compression spring 80 is disposed between the cage 74 and the ball 72 for urging the ball 72 toward the seat 66.

Constructing of the inlet check valve assemblies 50 and pump modules 12, 14 according to our invention allows the inlet check valve assemblies 50 to be built and tested independently from the remainder of the pump modules 12, 14, and then be inserted through a simple press fit operation into the inlet valve bores 62 of the pump modules 12, 14. Having the inlet check valve assemblies 50 completely separate from the piston 40, as compared to being located inside of, or riding on the outside of the piston as was the case in prior controlled braking pumps, provides considerable simplification of construction of pump modules 12, 14 according to the invention.

With the inlet check valve assemblies 50 separated from the piston 40, the piston can be made shorter and smaller in diameter, because it no longer needs to internally accommodate the inlet valve. Having a shorter piston 40 allows pump modules 12, 14 to be physically shorter, and yet still provide sufficient pumping displacement compared with prior controlled braking pumps, because the piston stroke can be longer in modules 12, 14 according to the invention. A longer piston stroke coupled with a smaller diameter piston also tends to produces less noise during operation of the pump.

Each of the pump modules 12, 14 also includes a return spring 82 operatively connected between the second end 26 of the sleeve 20 and the exposed end 42 of the piston 40 for urging the exposed end 42 of the piston 40 to move outward from the sleeve 20 along the reciprocating axis 34. The return spring 82 bears against a retaining ring 84 extending radially outward from a groove in the exposed end 42 of the piston 40.

Those having ordinary skill in the art will recognize that to this point the two pump modules 12, 14 of the exemplary embodiment of the pump 10 are identical. Each of the pump modules 12, 14 also respectively includes a cap 86, 88 at the first end 24 of the sleeve 20 for closing the inlet 36. As will be readily seen from FIGS. 1–3, however, the cap 86 of the first module 12 is not identical to the cap 88 of the second module 14.

The cap 86 of the first module 12 has a stepped, annular-shaped, solid body with a cross drilled bore 90 intersecting a central blind bore 92 extending into the cap 86 along the reciprocating axis 34. The cross-drilled bore 90 and central blind bore 92 provide fluid communication with an annular inlet groove 94 formed between the first pump module 12 and a cavity 96 in the pump housing 16, as shown in FIG. 1, for receiving the first module 12.

The first module 12 also includes three O-rings 100, 102, 104 disposed in grooves on the outside surfaces of the cap 86 and sleeve 20, that, in combination with the cavity 96 in the pump housing 16 seal the annular inlet groove 94 from an annular outlet groove 106 also formed between the outer surface of the first module 12 and the cavity 96 in the pump housing 16. The inlet and outlet annular grooves 94, 106 connect respectively with inlet and outlet ports (not shown) in the pump housing 16 for connecting the pump 10 to a controlled braking system.

As shown in FIGS. 1 and 3, the cap 88 of the second pump module 14 includes a fluid reservoir 108 in fluid communication with the inlet 36. The cap 88 is an assembly of an outer cap housing 110, an intermediate housing 112, a movable wall in the form of a flexible diaphragm 114, and a compression spring 116. The intermediate housing 112 includes a central thru-bore 118 extending along the reciprocating axis 34 and providing fluid communication between the inlet 36 and the fluid reservoir 108. The intermediate housing also includes a cross-bore 120 for connecting the inlet 36 to an annular inlet groove 122 formed between the second pump module 14 and a cavity 124 in the pump housing 16 for receiving the second pump module 14, in the same manner as described above in relation to the first pump module 12. The intermediate housing 112 also includes a pair of thru-bores 126 extending through the intermediate housing 112 in parallel to the central bore 118, and connecting the fluid reservoir 108 to the cross-bore 120. The flexible diaphragm 114 rests in a cavity 128 in the outer housing 110 and has a bead 130 trapped between and forming a fluid seal between the intermediate and outer housings 112, 110 of the cap 88. The outer housing 110 also includes a vent hole 132 connecting the cavity 128, on the outside of the diaphragm 114 to the ambient air outside of the outer housing 110 of the cap 88. The compression spring 116 is disposed between the inner surface of the diaphragm 114 and the second end 26 of the sleeve 20 of the second module 14.

The fluid reservoir 108 provides a small volume of fluid to aid in priming the pump 10 and starting the flow of fluid particularly when the pump 10 is operating with cold fluid. During a typical pumping cycle in a controlled braking event, a partial vacuum is created at inlet 36. When the pump 10 is started, the piston 40 of the second module 14 can draw fluid for priming the pump 10 from the small volume of fluid stored in the reservoir 108 into the cylinder bore 30 far more readily than it could otherwise draw fluid from the remote reservoir (not shown) in the rest of brake system. This is especially beneficial in cold temperatures when increased fluid viscosity further inhibits flow. The diaphragm 114 can move and vary the displacement of the fluid reservoir 108, with air entering through the vent 132 into the cavity 128 behind the diaphragm 114 to keep the inlet 36 essentially at atmospheric pressure. Once the pumping cycle is complete and the partial vacuum at the pump inlet is depleted, the reservoir 108 is refilled with fluid from the action of the return spring 116 reseating flexible diaphragm 114 into its original position in cap housing 110.

In the pump 10 of the exemplary embodiment, only the second pump module 14 includes the cap 88 having the fluid reservoir 108. In other embodiments of our invention, both or neither of the first and second pump modules 12, 14 may include the cap 88 having the fluid reservoir 108, depending upon the needs of the braking system. The first and second pump modules 12, 14 may also feed separate braking circuits, the same braking circuit, or the second pump module 14 may be connected to serve as a priming pump for the first pump module 12.

The first and second pump modules 12, 14 are retained in their respective cavities 92, 124 in the housing 16 by staking a portion of the housing 16 against the caps 86, 88 of the first and second pump modules 12, 14, as indicated by arrows 125 in FIG. 1.

Figure 5:
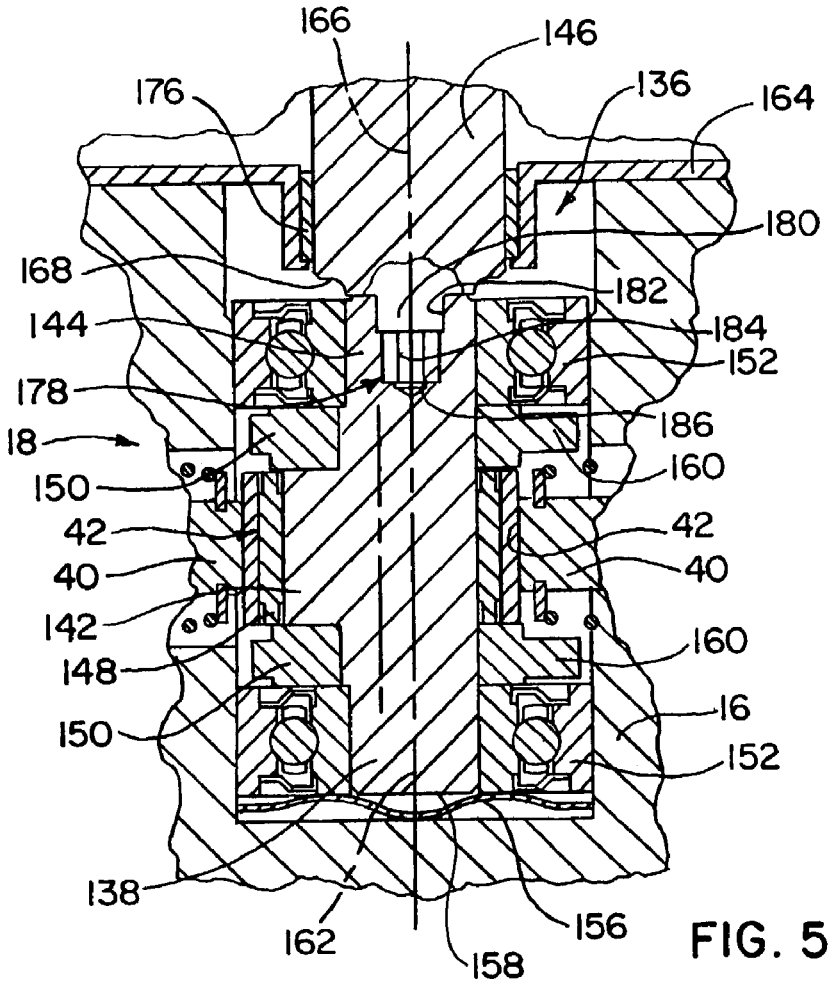
FIG. 5 is an enlarged partial cross section of a first embodiment of a pump drive apparatus, according to the invention, for the pump of FIG. 1.

As shown in FIGS. 1 and 5, the pump drive apparatus 18 includes a stub shaft 138 and an electric motor 140. The stub shaft 138 is journalled in a cavity 136 of the pump housing, 16, connecting the cavities 96, 124 in the housing 16 for receiving the first and second pump modules 12, 14. The stub shaft 138 includes a rotating eccentric 142 and a driven end 144 of the stub shaft 138 adapted for operative connection to a rotating drive shaft 146 extending from the motor 140. The pump drive apparatus 18, of FIGS. 1 and 5, further includes a needle bearing 148 disposed between the rotating eccentric 142 and the exposed ends 42 of the pistons 40 of the first and second modules 12, 14. A pair of thrust bearings 150 is disposed on the stub shaft 138 and abutting the needle bearing 148 at opposite axial ends of the needle bearing 148. A pair of rotating bearings 152 is disposed between the stub shaft 138 and the pump housing 16, abutting the thrust bearings 150 on opposite sides of the rotating eccentric 142 for supporting the pump drive apparatus 18 in the housing 16.

The drive apparatus 18 in the embodiment shown in FIG. 1 includes a retainer element in the form of a retaining ring 154 abutting the top surface of the top rotating bearing 152 and connected to the housing 16 through staking, or alternatively by being inserted into a groove in the housing 16, for limiting axial movement of the stub shaft 138 in the housing 16. A thrust washer, in the form of a wavy spring washer 156, is disposed between the housing 16 and the rotating bearing 152 at the end 158 of the stub shaft 138 opposite the drive end 144 for loading the pump drive apparatus 18 against the retaining ring 154.

Figure 9:
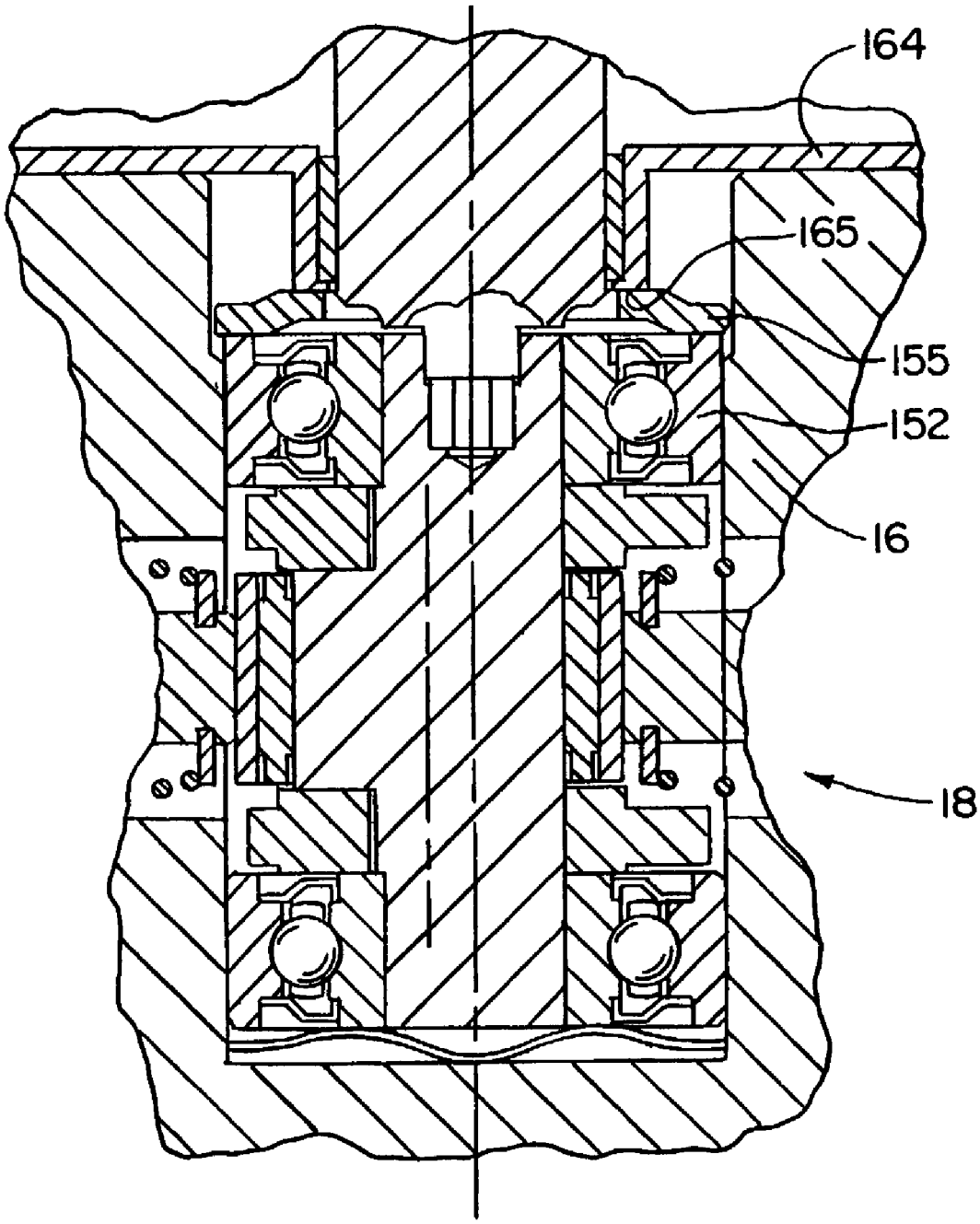

There are many other ways in which the drive apparatus 18 can be retained axially against the force exerted by the wavy spring washer 156. For example, as shown in FIG. 9, a contoured retaining ring 155 is operatively connected to the housing 16 by clamping the contoured retaining ring 155 between the top surface of the top bearing 152 and a lower surface 165 of the motor housing 164.

The thrust bearings 150 are each configured to provide a counterweight 160 for balancing the pump drive apparatus 18, to counteract dynamic forces generated by the eccentric 142 and needle bearing 148 as the stub shaft 138 rotates about a rotational axis 162 of the drive apparatus 18. Configuring the thrust washers 150 to include the counterweights 160 provides a significant advantage over prior controlled braking pumps without the separately supported stub shaft 138.

The motors in prior pumps had to include extra laminations or brass weights on the motor rotor for balancing those prior pumps against the dynamic forces generated by the eccentric elements attached to the motor drive shaft. These counterweights inside the motors of prior pumps had to be specifically matched to one particular drive mechanism. If the offset of the eccentric was increased or decreased to change the stroke of the prior pumps, for instance, a different motor having appropriate counterweights was required. Eliminating the counterweights inside the motor 140 by having the drive mechanism 138 be self-supporting, according to the invention, allows a given motor 140 to be used in multiple pump embodiments that may have different drive mechanisms 18 for providing different displacements, thereby greatly facilitating construction of the pump 10 and reducing inventory requirements for the motors 140 required for providing a number of pump 10 configurations specifically configured to the requirements of the vehicle in which the pump 10 is to be installed.

Having the drive apparatus 18 be self supported within the housing 16 on the two rotating bearings 152 simplifies the construction and reduces the cost of the motor 140. The addition of the upper bearing 152 in the drive apparatus 18 allows a similar bearing, required in the motors of prior controlled braking pumps at the point where the motor drive shaft emerges from the motor, to be eliminated from the motor 140 in the exemplary embodiments of our invention shown in FIGS. 1 and 5.

As shown in FIGS. 1 and 5, the motor 140 in the exemplary embodiments of the invention described thus far includes a motor housing 164 for attachment of the motor 140 to the pump housing 16. The rotating drive shaft 146 defines an axis of rotation 166, a drive end 168 adapted for operative connection to the driven end 144 of the stub shaft 138, and an anti-drive end 170 at the upper end of the motor 140 as depicted in FIGS. 1 and 5.

A rotating drive shaft bearing 172 is attached to the motor housing 164 for journaling the anti-drive end 170 of the rotating drive shaft 146. The drive shaft bearing 172 has a spherical outer surface 174 thereof operatively connected to the motor housing 164 for allowing the rotating drive shaft 146 to nutate about the axis 166 of the rotating drive shaft 146. Having the drive shaft 146 supported at its anti-drive end 170 in the bearing 172 in this manner, facilitates alignment of the axis 166 of the drive shaft 166 of the motor 140 to the axis 162 of the stub shaft 138, to prevent binding and introduction of undesirable side loads or bending forces on the motor drive shaft 166 and stub shaft 138.

A bushing 176 of a low friction material, such as Nylon or plastic, is attached to the motor housing 164 adjacent the drive end 168 of the rotating drive shaft 146, for loosely journaling the drive end 168 of the drive shaft 146 during assembly and test operations performed on the motor 140 prior to attaching the drive end 168 of the motor drive shaft 146 to the drive end 168 of the stub shaft 138. This bushing 164 is not necessarily used for supporting the motor drive shaft 146 during operation of the pump 10, and may thus be fabricated by inexpensive methods, such as molding, from a low cost material.

The drive end 168 of the rotating drive shaft 146 of the motor 140 is connected to the driven end 144 of the stub shaft 138 by a compliant drive coupling 178, for accommodating misalignment of the axes 166, 162 of the drive shaft 146 and stub shaft 138. In the embodiments shown in FIGS. 1 and 5, the drive end 168 of the motor drive shaft 146 includes a cylindrical pilot segment 180, of reduced diameter, that engages a close fitting cylindrical pilot bore 182 in the driven end 144 of the stub shaft 138. Extending from the end of the pilot 180 of the motor drive shaft 146 is a hex-shaped drive element 184 that drivingly engages a corresponding hex-shaped socket 186 extending from the bottom end of the pilot bore 182 into the stub shaft 138.

While the description of the invention above has utilized certain exemplary embodiments for the purpose of explanation, the invention may also be practiced in a number of other embodiments. Furthermore, various changes and modifications can be made from the disclosed embodiments without departing from the spirit and scope of the invention.

For example, a pump according to our invention may have only one, or more than two pump modules 12, 14, i.e. three, four or more. The sleeve 20 of the pump modules 12, 14, may be expanded to in essence become one with the pump housing 16.

Figure 6:
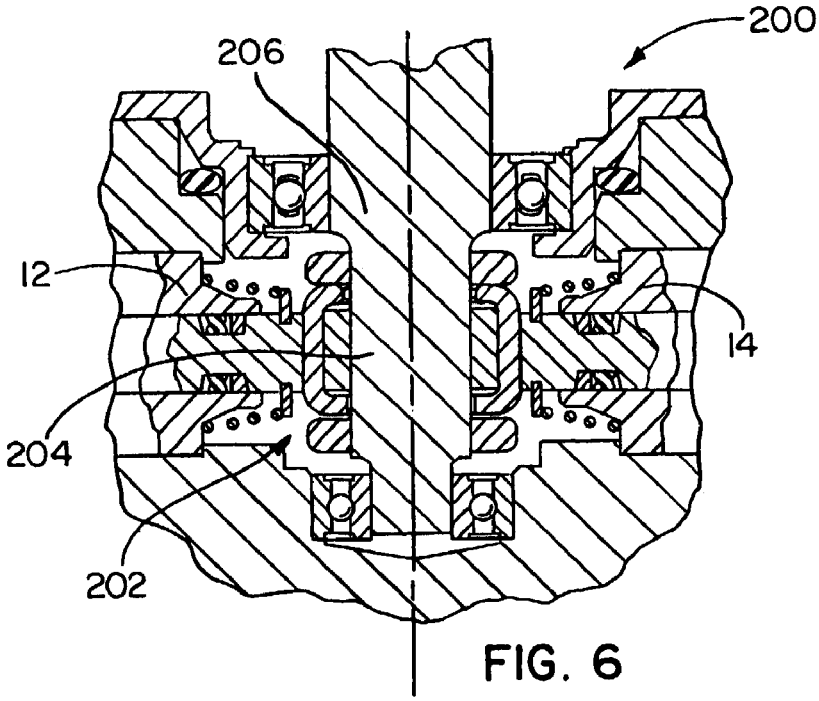
FIGS. 6–11 are enlarged cross sections of exemplary embodiments of several alternate drive mechanisms, and connections between the alternate drive mechanisms and pump modules, according to of our invention.
Figure 7:
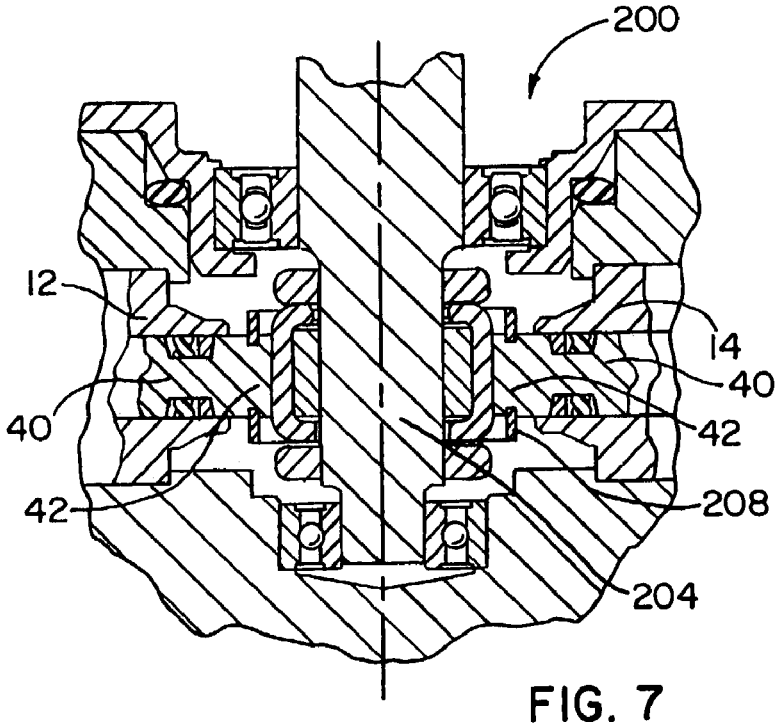

As shown in FIG. 6, pump modules 12, 14 according to our invention can be used in embodiments of pumps 200 having different types of drive mechanisms 202 from the drive mechanism 18 described above. The drive mechanism 202, in the embodiment shown in FIG. 6, includes an eccentric 204 attached to the motor shaft 206, rather than having the self supporting stub shaft 138 of the exemplary embodiments described above. As shown in FIG. 7, the return springs 82 may be eliminated from pump modules 12, 14 according to our invention, and the exposed ends 42 of the pistons 40 connected to the eccentric 204 with a retainer clip 208. The return springs 82 can also be eliminated and the retainer clip 208 used to connect the exposed ends 42 of the pistons 40 to the eccentric 142 on the stub shaft 138 of the embodiments of our invention shown in FIGS. 1, 5 and 8.

Figure 8:
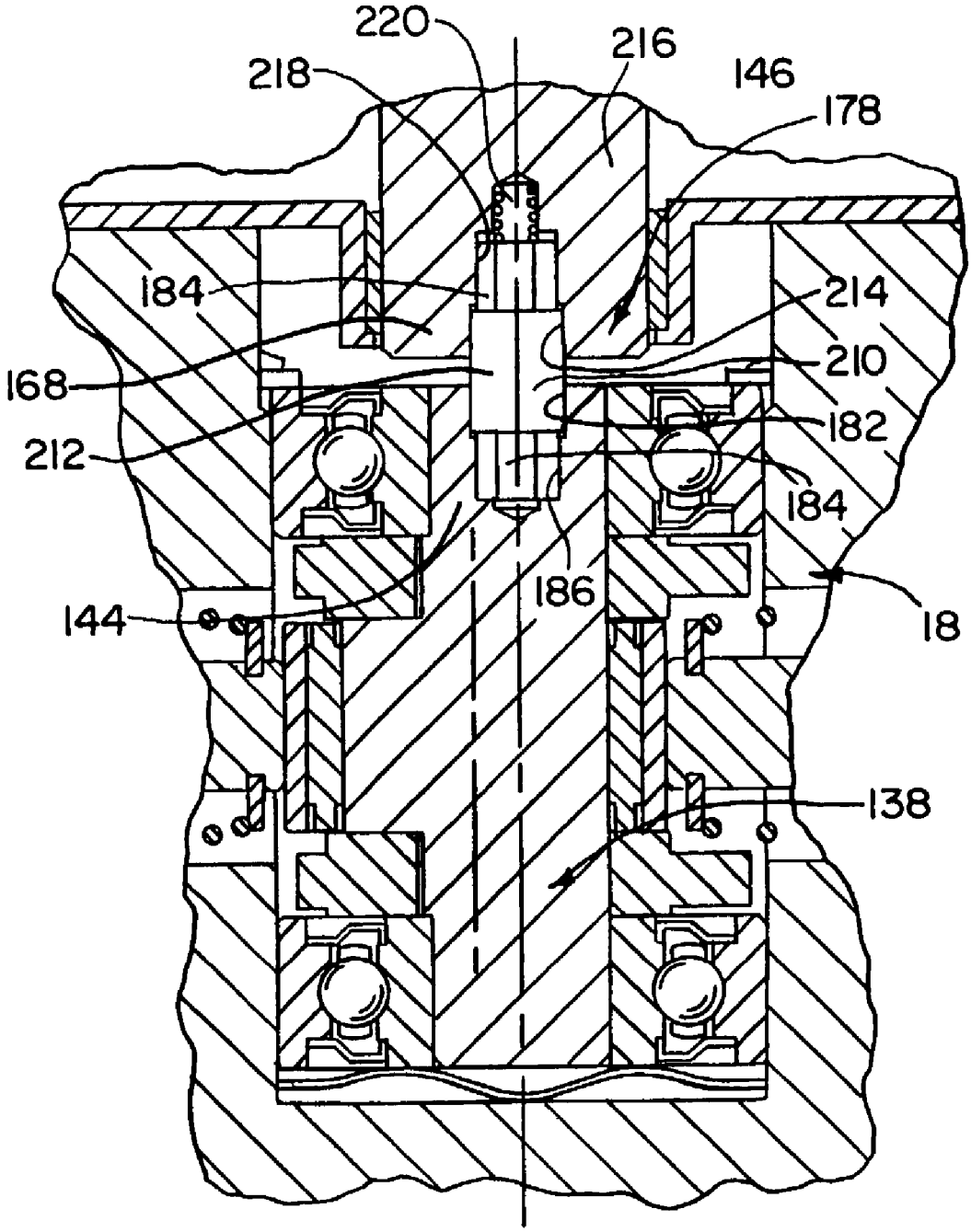

Our invention may also utilize a different type of compliant coupling 178 for joining the drive end 168 of the motor drive shaft 146 to the driven end 144 of the stub shaft 138. For example, as shown in FIG. 8 the compliant coupling 178 may include a separate quill shaft 210 having a cylindrical pilot central section 212 and a hex-drive element 184 at each end of the quill shaft 210. The motor drive shaft 146 includes a cylindrical pilot bore 214, that engages in a close fit the cylindrical pilot section 212 of the quill shaft 210 in the drive end 168 of the motor drive shaft 146. Extending from the end of the cylindrical pilot bore 214 into the motor drive shaft 146 is a hex-shaped drive socket 216 that drivingly engages the corresponding hex-shaped element 184 extending from the upper end of the quill shaft 210. The compliant coupling 178 may further include a small compression spring 218 disposed in a spring pocket 220 extending into the motor drive shaft 146 from the upper end of the hex-shaped socket 214, for keeping the quill shaft 210 from vibrating axially, thereby reducing noise in the drive mechanism 18 and preventing brinelling wear of the quill shaft 210 and the bores 182, 184, 214, 216 engaging the quill shaft 210.

Figure 10:
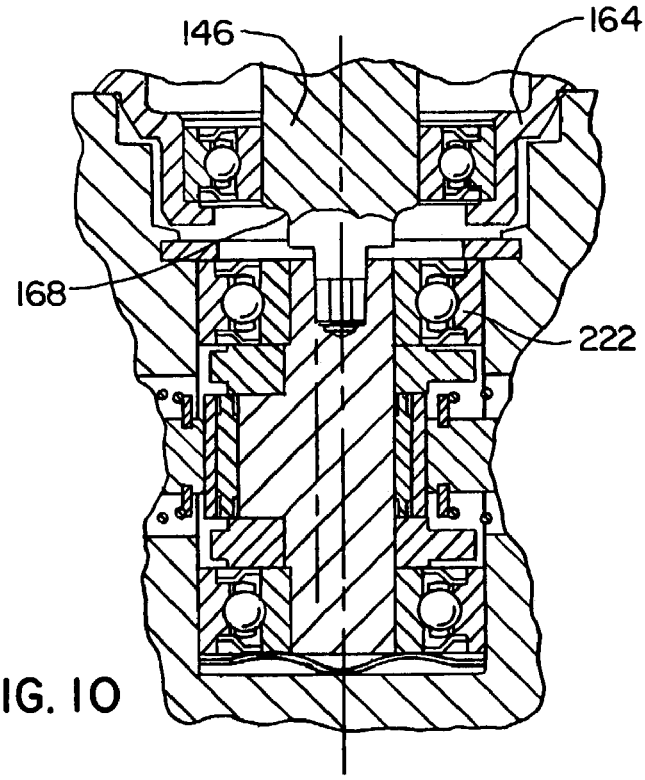
Figure 11:
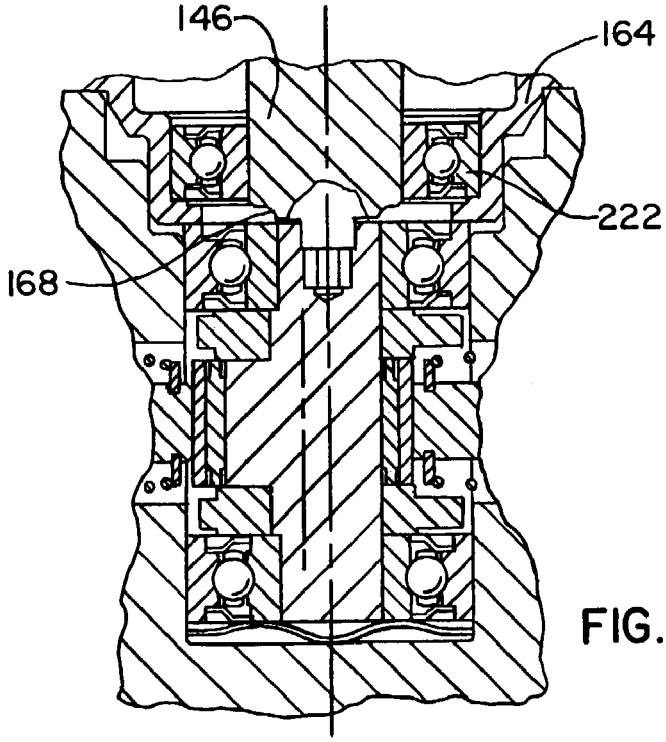

The invention may also be practiced with motors having a bearing 222 attached to the motor housing 164 at the drive end 168 of the drive shaft 146, as shown in FIGS. 10 and 11, in accordance with various aspects and elements of the exemplary embodiments described above.

The scope of the invention is indicated in the appended claims. We intend that all changes or modifications within the meaning and range of equivalents are embraced by the claims.

What is claimed is:

1. A pump comprising:

a sleeve having a wall defining, a cylinder bore and a reciprocating axis extending through the cylinder bore from a first to a second axial end of the sleeve, an inlet extending along the reciprocating axis from the first axial end of the sleeve in fluid communication with the piston bore, and an outlet passing through wall and in fluid communication with the cylinder bore between the first and second axial ends of the sleeve;

a piston in the cylinder bore for sliding motion along the reciprocating axis, and having an exposed end thereof extending from the second end of the sleeve adapted for connection to a drive mechanism;

an inlet check valve assembly disposed in the inlet;

an outlet check valve assembly disposed in the outlet;

a pump housing having a cavity for receiving the sleeve; and a pump drive apparatus attached to the pump housing and including a rotating eccentric operatively connected to the exposed end of the piston for imparting reciprocating motion to the piston within the cylinder bore, wherein the pump drive apparatus includes a stub shaft journalled in the housing, and including the rotating eccentric, the stub shaft further including a driven end thereof adapted for operative connection to a rotating drive shaft;

a needle bearing disposed between the rotating eccentric and the exposed end of the piston;

a pair of thrust bearings disposed on the stub shaft and abutting the needle bearing at opposite axial ends thereof;

a pair of rotating bearings disposed between the stub shaft and the pump housing abutting the thrust bearings on opposite sides of the rotating eccentric for supporting the pump drive apparatus in the housing;

a retainer element abutting one of the rotating bearings and connected to the housing for limiting axial movement of the stub shaft in the housing; and a thrust washer disposed between the housing and the rotating bearing at the end of the stub shaft opposite the drive end for loading the pump drive apparatus against the retainer element.

2. The pump of claim 1 wherein the pump drive apparatus includes a motor having a rotating shaft extending therefrom, and having the rotating eccentric operatively connected to the shaft.

3. The pump of claim 1 wherein the pump drive apparatus includes a motor having a rotating shaft extending therefrom operatively connected to the drive end of the stub shaft.

4. The pump of claim 1 wherein at least one of the thrust bearings includes a counterweight for balancing the pump drive apparatus.

5. The pump of claim 1 wherein the rotating drive shaft defines an axis of rotation, a drive end adapted for operative connection to the stub shaft, and an anti-drive end, and the motor further comprises:

a motor housing for attachment of the motor to the pump housing;

a rotating drive shaft bearing attached to the motor housing for journaling one end of the rotating drive shaft, and having a spherical outer surface thereof operatively connected to the motor housing for allowing the rotating shaft to nutate about the axis of the rotating drive shaft; and a bushing attached to the motor housing adjacent the drive end of the rotating drive shaft and loosely journaling the drive end of the drive shaft during assembly and test operations performed on the motor prior to attaching the drive end of the motor drive shaft to the drive end of the stub shaft.

6. The pump of claim 5 further including a compliant drive coupling connecting the drive end of the motor shaft to the drive end of the stub shaft, for accommodating misalignment of the drive ends of the shafts.

* * * * *